US006526773B1

(12) United States Patent
Cho

(10) Patent No.: US 6,526,773 B1
(45) Date of Patent: Mar. 4, 2003

(54) AIR CONDITIONER

(75) Inventor: Kee-Youen Cho, Suwon (KR)

(73) Assignee: Samsung Electronics, Co., Ltd., Suwon (KR)

( * ) Notice: Subject to any disclaimer, the term of this patent is extended or adjusted under 35 U.S.C. 154(b) by 0 days.

(21) Appl. No.: 10/118,146

(22) Filed: Apr. 9, 2002

(30) Foreign Application Priority Data

Nov. 27, 2001 (KR) ..... 2001-74313

(51) Int. Cl.[7] ..... F25D 23/12
(52) U.S. Cl. ..... 62/262; 62/298; 62/317
(58) Field of Search ..... 62/262, 315, 298, 62/427, 317; 454/201

(56) References Cited

U.S. PATENT DOCUMENTS 4,416,327 A * 11/1983 Nakada et al. ..... 165/122
6,354,936 B1 * 3/2002 Noh et al. ..... 454/201

FOREIGN PATENT DOCUMENTS

DE 3225502 * 1/1984 ..... 62/298
JP 58-2533 A * 1/1983 ..... 62/298

OTHER PUBLICATIONS

Kin Daeto, Patent Abstracts of Japan, "Grill Hinge Device of Window Type Air Conditioner", Publication No. 11–316032, Nov. 16, 1999.

* cited by examiner

*Primary Examiner*—Denise L. Esquivel
*Assistant Examiner*—Melvin Jones
(74) *Attorney, Agent, or Firm*—Staas & Halsey LLP

(57) ABSTRACT

An air conditioner having a first connecting unit and a second connecting unit. The first connecting unit is forwardly protruded by a predetermined length from the front surface of the front panel and has a hinge shaft on an end thereof. This first connecting unit rotatably holds the intake grille to the front panel and allows the intake grille to be opened at a wide angle. The second connecting unit is provided on the inner surface of a bent portion formed along the side of the intake grille and has a hole to receive the hinge shaft.

16 Claims, 5 Drawing Sheets

AIR CONDITIONER

CROSS-REFERENCE TO RELATED APPLICATIONS

This application claims the benefit of Korean Patent Application No. 2001-74313 filed on Nov. 27, 2001, in the Korean Industrial Property Office, the disclosure of which is incorporated herein by reference.

BACKGROUND OF THE INVENTION

1. Field of the Invention

The present invention relates generally to an air conditioner, and more particularly, to an air conditioner which includes an improved hinge unit to allow an intake grille to be opened at a wide angle.

2. Description of the Related Art

Generally, a window type air conditioner has provided on the front surface of its body first air inlet and outlet ports to respectively suck in and discharge room air, and has provided on the rear portion of the body second air inlet and outlet ports to respectively suck in and discharge outdoor air.

FIG. 1 illustrates a conventional window type air conditioner. In this figure, a body 1 is provided with a front panel 2 having an air inlet port 2*a* through which room air flows into the body 1. A heat exchanger 3 is installed in the body 1 at a position close to the air inlet port 2*a* of the front panel 2 to absorb heat from the room air. An intake grille 4 having a plurality of vents 4*a* is connected to the front panel 2 to cover the front panel 2. An intake filter 5 is detachably mounted on the inner surface of the intake grille 4 to remove impurities, such as dust, from the room air flowing into the air conditioner.

The intake grille 4 is rotatably connected at a side edge thereof to the front panel 2 such that the intake grille 4 is opened and closed by rotating it at a predetermined angle when it is required to clean the filter 5 or replace the filter 5 with a new one. In order to allow the intake grille 4 to be rotatably held to the front panel 2, the intake grille 4 is provided on its inner surface with a connecting unit 6 in such a way that the connecting unit 6 extends toward the front panel 2 by a predetermined length. This connecting unit 6 has provided on an end thereof a hook-shaped connecting member 6*a*. To receive the connecting unit 6, a slot 7 of a predetermined depth is formed on the front panel 2 at a position facing the connecting unit 6. A hinge shaft 8 is provided in the slot 7 such that the connecting member 6*a* of the connecting unit 6 is rotatably held to the hinge shaft 8.

Since the air conditioner is designed such that the intake grille 4 is rotated around the hinge shaft 8, with the connecting unit 6 of the intake grille 4 inserted into the slot 7 of the front panel 2, the connecting unit 6 is caught by the mouth of the slot 7, so that the intake grille 4 cannot be opened at a desired wide angle when it is required to open the intake grille 4 for cleaning the intake filter 5 or replacing the filter 5 with a new one. Thus, the conventional air conditioner has a problem in that it is inconvenient for a user wanting to clean the intake filter 5 or replace the filter 5 with a new one. The conventional air conditioner has another problem in that the connecting unit 6 may be broken when the intake grille 4 is forcibly opened to a wide angle.

SUMMARY OF THE INVENTION

Accordingly, it is an object of the present invention to provide an air conditioner which allows its intake grille to be opened at a desired wide angle, thus allowing a user to easily clean an intake filter or replace the filter with a new one.

It is another object of the present invention to provide an air conditioner which allows the intake grille to be opened at the desired wide angle while minimizing a gap between a front panel and the intake grille when the intake grille is closed, thus having a good appearance.

Additional objects and advantages of the invention will be set forth in part in the description which follows and, in part, will be obvious from the description, or may be learned by practice of the invention.

The foregoing and other objects of the present invention are achieved by providing an air conditioner having a front panel provided with an air inlet port and an intake grille connected to the front panel to cover the front of the panel, wherein the air conditioner comprises: first connecting units forwardly protruding by a predetermined length from the front surface of the front panel, having a hinge shaft on an end of each first connecting unit, rotatably holding the intake grille to the front panel, and allowing the intake grille to be opened at a wide angle; and second connecting units provided on the inner surface of a bent portion formed along a side of the intake grille, and each having a hole to receive the hinge shaft.

The first connecting unit comprises: a forward extension part forwardly extending from the front panel by a predetermined length and a side extension part extending sideward from an end of the forward extension part by a predetermined length.

A predetermined space is defined between the front surface of the front panel and the side extension part to receive the bent portion of the intake grille when the intake grille is rotated around the hinge shaft to be opened.

The hinge shaft vertically extends from an end of the side extension part in an upward or downward direction.

The hole of each second connecting unit is eccentrically positioned proximately to an edge of the bent portion of the intake grille such that the rotation radius of the bent portion is minimized and a gap between the edge of the bent portion and the front panel is minimized when the intake grille is closed.

Each hole is partially opened toward the front surface of the front panel to form a mouth having a width smaller than the diameter of the hinge shaft so that the intake grille is easily attached to or easily detached from the front panel.

Furthermore, the front panel is provided on its front surface with a vertical groove to prevent the bent portion of the intake grille from interfering with the front panel when the intake grille is rotated to be opened or closed.

BRIEF DESCRIPTION OF THE DRAWINGS

These and other objects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
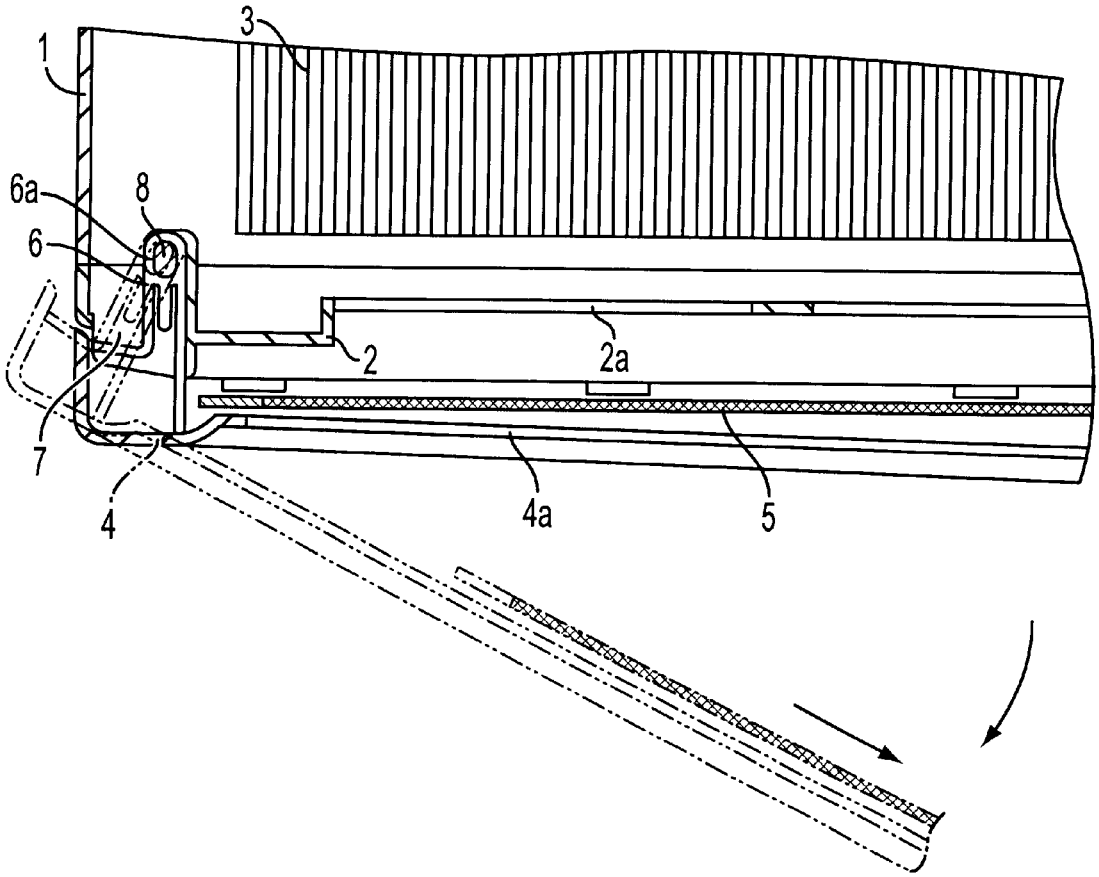
FIG. 1 (PRIOR ART)
FIG. 1 is a sectional view illustrating a conventional air conditioner provided with an intake grille.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 2:
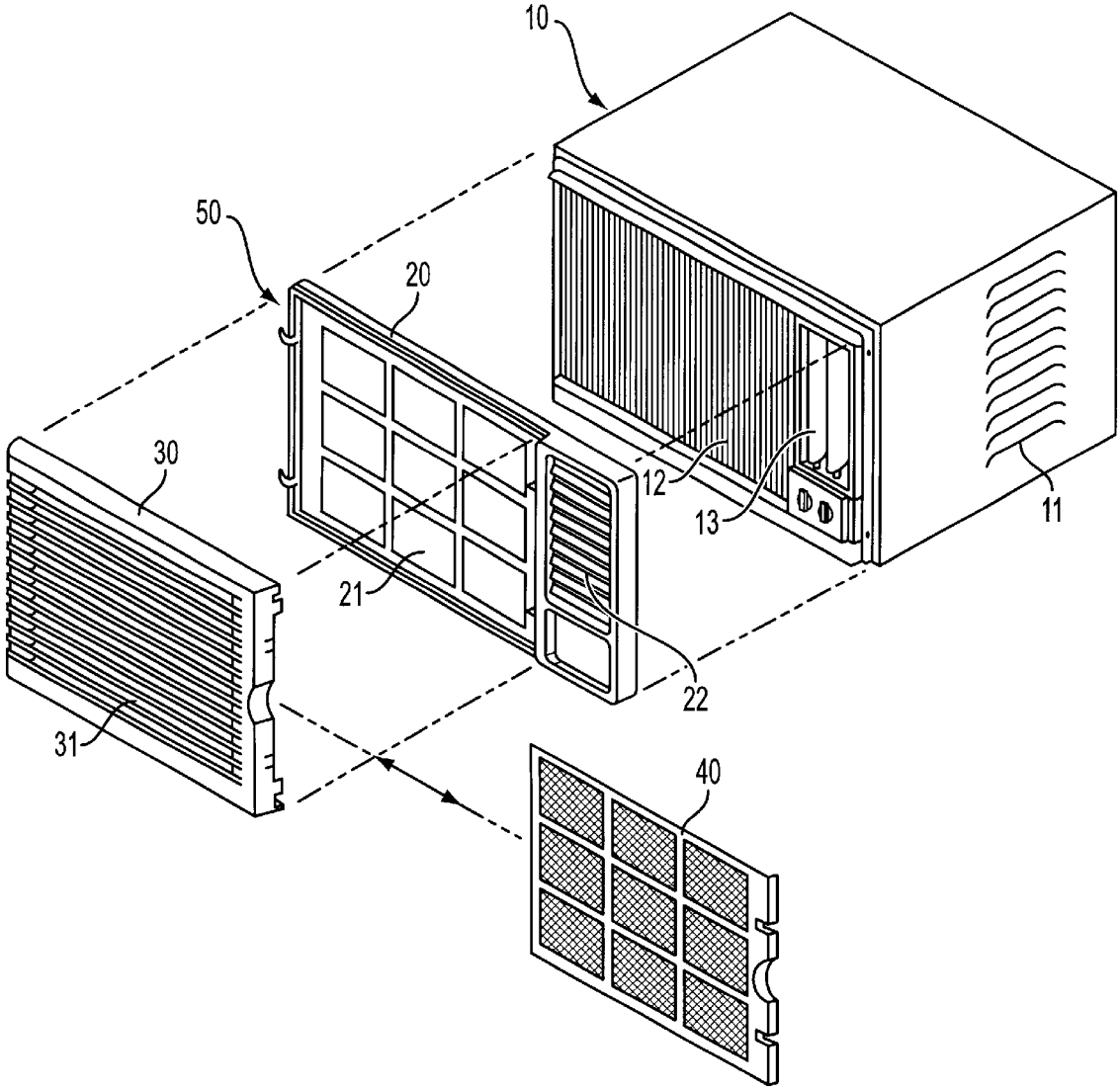
FIG. 2 is an exploded perspective view illustrating the construction of the front part of an air conditioner according to this invention.

As illustrated in FIG. 2, in the air conditioner of this invention, a front panel 20 is mounted on the front surface of a body 10, and provided with a first inlet port 21 and a first outlet port 22 to respectively suck in and discharge room air. The body 10 is also provided on its rear portion with a second inlet port 11 and a second outlet port (not shown) to respectively suck in and discharge outdoor air.

A heat exchanger 12 is installed in the body 10 inside the front panel 20 to absorb heat from the room air which flows into the body 10 through the inlet port 21 of the front panel 20. An air discharge path 13 is formed at a side of the heat exchanger 12 to feed cool air from a blower (not shown) inside the body 10 to the room. The first inlet port 21 of the front panel 20 is the same size as that of the heat exchanger 12 so as to easily guide inlet room air to the heat exchanger 12, while the first outlet port 22 of the front panel 20 is the same size as that of the air discharge path 13 of the body 10.

An intake grille 30 having a plurality of vents 31 is connected to the front panel 20 to cover the front of the inlet port 21. An intake filter 40 is detachably mounted on the inner surface of the intake grille 30 to remove impurities, such as dust, from room air flowing into the air conditioner.

The intake grille 30 is rotatably connected at a side edge thereof to the front panel 20 such that the intake grille 30 is opened by the forward rotation of the intake grille 30 when it is required to clean the intake filter 40, or to replace the intake filter 40 with a new one. That is, the intake grille 30 is rotatably connected to the front panel 20 by a hinge unit 50 provided at the facing side ends of the front panel 20 and the intake grille 30.

Figure 3:
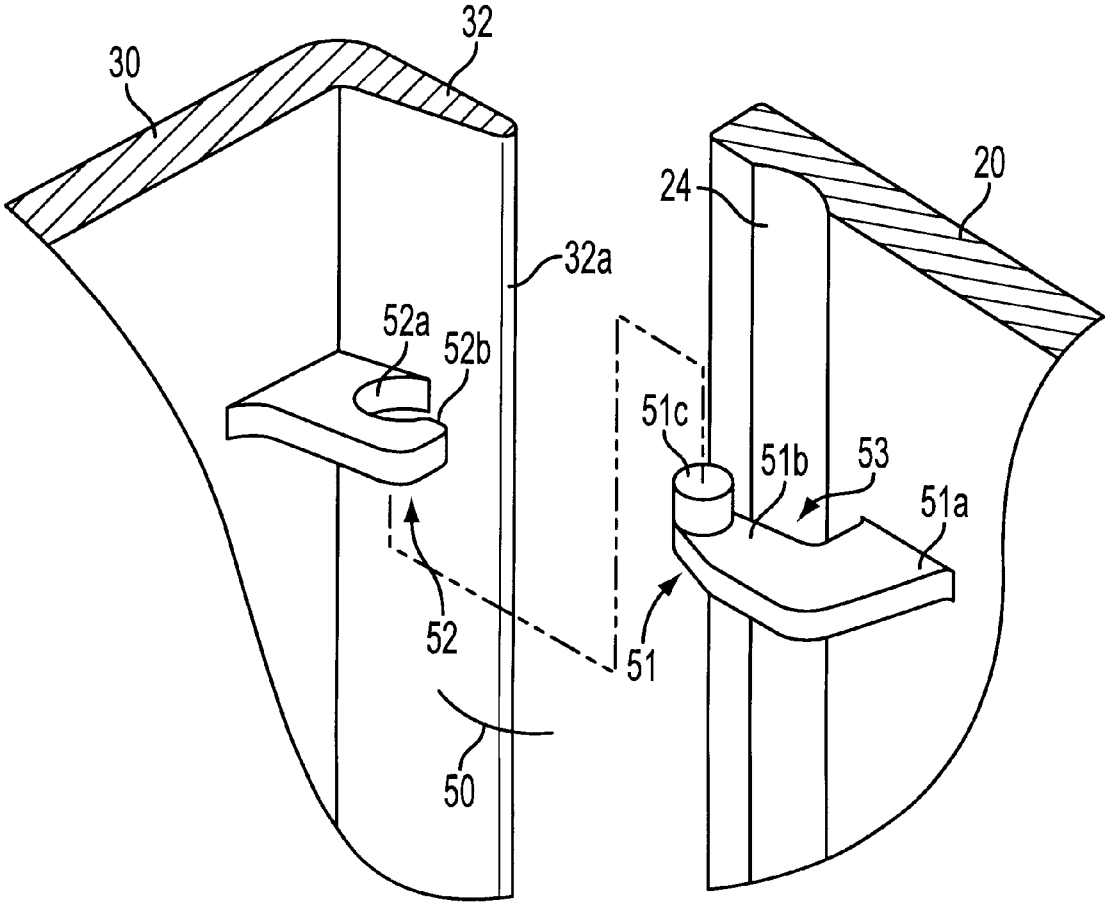
FIG. 3 is a perspective view of a hinge unit included in the air conditioner of this invention.
Figure 4:
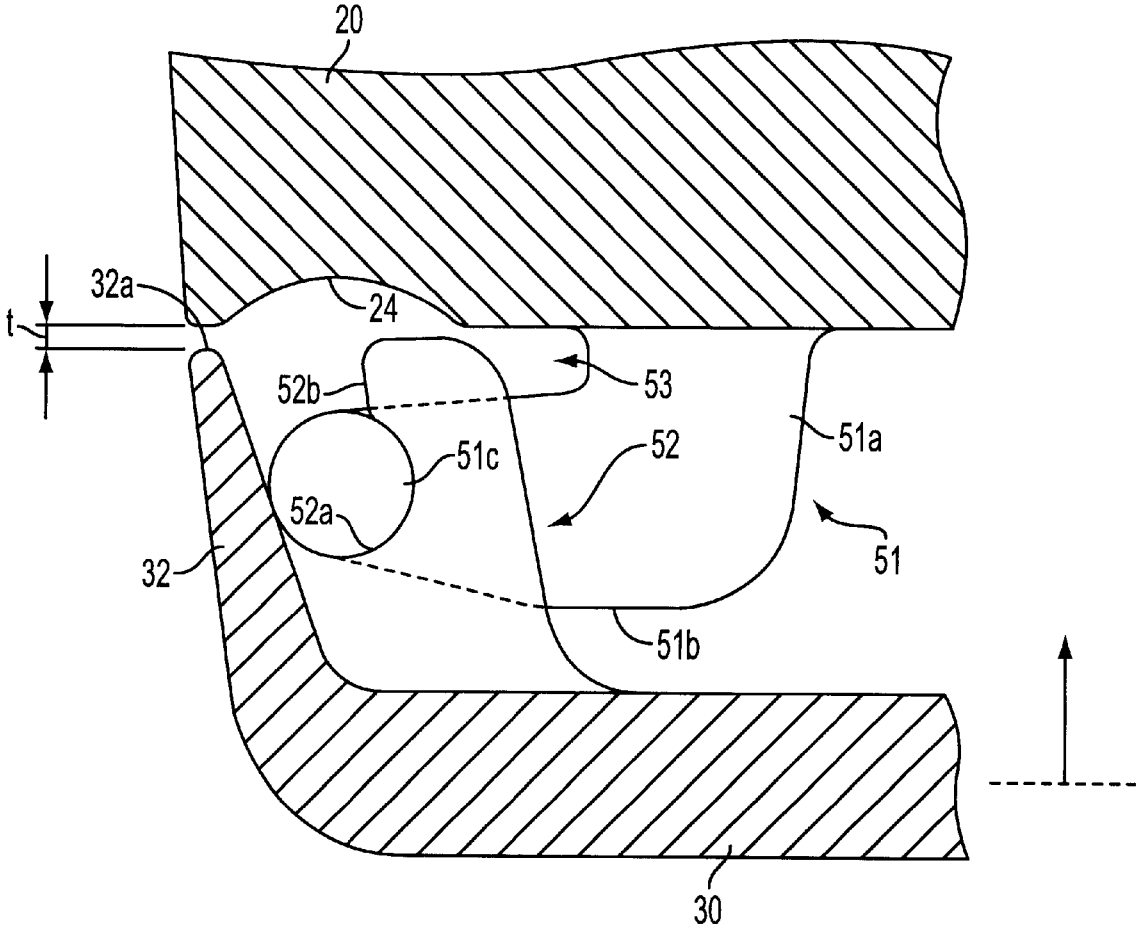
FIG. 4 is a plan view of the hinge unit included in the air conditioner of this invention when an intake grille is closed.

As shown in FIGS. 3 and 4, the hinge unit 50 includes first connecting units 51 and second connecting units 52 (only one is shown in these drawings). The first connecting units 51 are forwardly protruded from the front surface of the front panel 20, and have a hinge shaft 51*c*. The second connecting units 52 are provided on the inner surface of a bent portion 32 formed along a side of the intake grille 30, and are rotatably connected to the first connecting units 51, respectively. The second connecting units 52 each have a hole 52*a* to receive the hinge shaft 51*c* of the first connecting units 51.

The first connecting units 51 are integrally formed on each of upper and lower portions, respectively, of a side of the front panel 20. Each of the first connecting units 51 has a forward extension part 51 a forwardly extending from the front panel 20 by a predetermined length, and a side extension part 51*b* extending from the end of the forward extension part 51*a* by a predetermined length. Each hinge shaft 51*c* vertically extends by a predetermined length from the end of the side extension part 51*b*. The hinge shafts 51*c* may extend upwardly or downwardly (not shown in the drawings) from the end of the side extension part 51*b*. Due to the construction of the first connecting units 51, the rotation center of the intake grille 30 is positioned at the side of the intake grille 30, thus easily opening and closing the intake grille 30.

The second connecting units 52 are integrally formed on the inner surface of the bent portion 32 of the intake grille 30 at positions corresponding to each of the first connecting units 51, and each has a flat plate shape. In order to provide the second connecting units 52 with a predetermined strength, one side of each second connecting unit 52 is integrally formed along the inner surface of the front wall of the intake grille 30 while another side of each second connecting unit 52 is integrally formed along the inner surface of the bent portion 32. The hole 52*a* of each second connecting unit 52 is eccentrically positioned proximately to the edge 32*a* of the bent portion 32 of the intake grille 30 such that the grille 30 is easily rotated to be opened and closed. That is, the hole 52*a* is eccentrically positioned toward both the side of the intake grille 30 and the rear of the intake grille 30 adjacent to the front panel 20 such that the center of the hole 52*a* is positioned proximately to the edge 32*a* of the bent portion 32. It is an embodiment of the present invention to have the inner surface of the hole 52*a* tangentially meet that of the bent portion 32, and the bent portion 32 to be thinner than the front wall of the intake grille 30.

The hole 52*a* designed in this way ensures that the rotation radius of the bent portion 32 is minimized when the intake grille 30 is opened, thus allowing the intake grille 30 to be opened at a wide angle in addition to accomplishing a good appearance of the air conditioner by minimizing a gap (t) between the edge 32*a* of the bent portion 32 and the front panel 20 when the intake grille 30 is closed.

The hole 52*a* of each second connecting unit 52 is partially opened toward the front surface of the front panel 20 to form a mouth 52*b* so that the intake grille 30 is easily attached to or easily detached from the front panel 20. The mouth 52*b* has a width smaller than the diameter of the hinge shaft 51*c*. Such a design of the hole 52*a* ensures that the hinge shaft 51*c* is easily received in or easily removed from the hole 52*a* when the intake grille 30 is attached to or detached from the front panel 20. In this case, each second connecting unit 52 is designed such that the edges of the mouth 52*b* are elastically deformed when fitting or removing the shaft 51*c* into or from the hole 52*a* in order to provide a secure attachment between the hole 52 and the shaft 51*c*.

Figure 5:
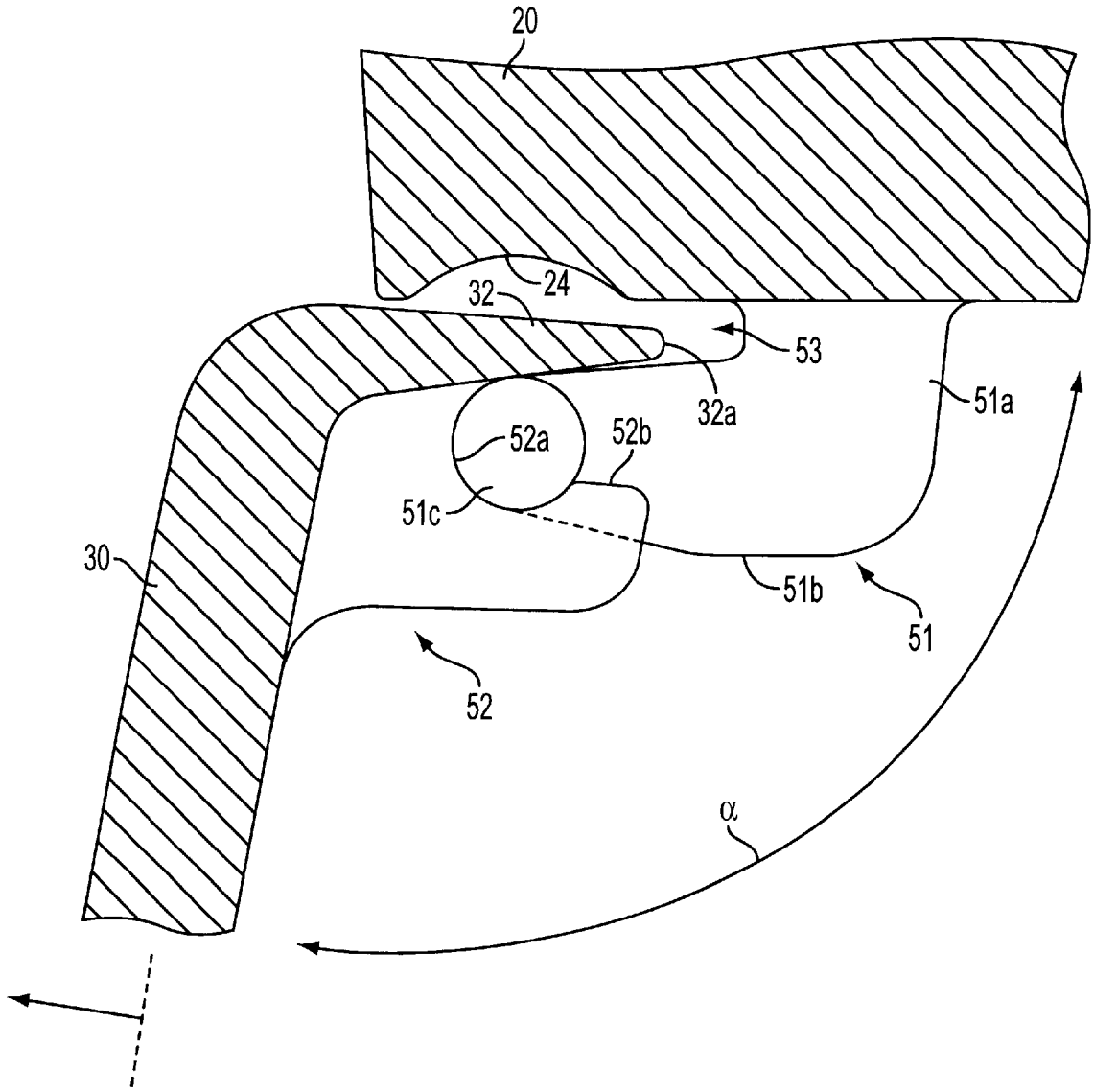
FIG. 5 is a plan view of the hinge unit included in the air conditioner of this invention when the intake grille is opened.

As shown in FIG. 5, the bent portion 32, which rotates when the intake grille 30 is opened, enters a space 53 between the front surface of the front panel 20 and the side extension part 51*b*. In order to allow the intake grille 30 to be opened at a wide angle, the space 53 is formed in such a way as to be larger in its size than the bent portion 32, thus providing the open angle ($\alpha$) of the intake grille 30 to be 90° or more so the intake filter 40 can be easily cleaned or replaced with a new one.

As shown in FIGS. 3 and 5, a vertical groove 24 is formed along the edge of the front surface of the front panel 20 at a position adjacent to the hinge shaft 51*c* of the first connecting unit 51 so as to prevent the edge 32*a* of the bent portion 32 from interfering with the front panel 20 when the intake grille 30 is rotated to be opened or closed. In this embodiment the inner surface of the vertical groove 24 has a radius of curvature larger than the rotation radius of the bent portion 32.

The operation of opening and closing the intake grille of the air conditioner according to this invention will be described in the following.

When it is required to attach the intake grille 30 to the front panel 20 using the first and second connecting units 51 and 52, the mouth 52*b* formed on the hole 52*a* of each second connecting unit 52 is disposed to be aligned with the hinge shaft 51*c*. Thereafter, when a user presses the intake grille 30 with a predetermined force, the mouth 52*b* of each second connecting unit 52 is elastically deformed by a predetermined amount to allow the hinge shaft 51*c* to be received into their respective hole 52*a*. When it is required to detach the intake grille 30 from the front panel 20, a user has only to pull the grille 30 from the panel 20 in a direction opposite to that when attaching the grille 30 to the panel 20. Then, each mouth 52*b* is elastically deformed in the same manner as when attaching the intake grille 30 to the front panel 20, and simultaneously each hinge shaft 51*c* is removed from its respective hole 52*a*.

Since each hinge shaft 51*c* upwardly (or downwardly) extends by a predetermined height (or length) from the end of the side extension part 51*b* of the first connecting unit 51, the insertion of each hinge shaft 51*c* into its respective hole 52*a* may be accomplished by lowering the hole 52*a* over the shaft 51*c* in a direction from the top to the bottom of the shaft 51*c*. On the other hand, the removal of each hole 52*a* from the hinge shaft 51*c* may be accomplished by moving the hole 52*a* upward from the shaft 51*c*.

When it is required to open the intake grille 30 to clean or replace the intake filter 40, as shown in FIG. 5, the intake grille 30 is rotated around each hinge shaft 51*c*. In such a case, the bent portion 32 of the grille 30 enters the space 53 between the front panel 20 and the side extension 51*b* of the first connecting unit 51. The intake grille 30 is thus opened at a wide angle, that is, 90° or more. At this time, since each hinge shaft 51*c* and its respective hole 52*a* are eccentrically positioned with respect to the bent portion 32 of the intake grille 30, the rotation radius of the bent portion 32 is small, thus easily opening the intake grille 30 as well as allowing the open angle ($\alpha$) of the intake grille 30 to be large. Furthermore, since the vertical groove 24 is formed on the front panel 20, the intake grille 30 is easily opened without causing an interference of the edge 32*a* of the intake grille's bent portion 32 with the front panel 20. As such, when the intake grille 30 is opened at the wide angle, a user easily can clean or replace the intake filter 40 with a new one.

When the user closes the intake grille 30, as shown in FIG. 4, the gap (t) between the edge 32*a* of the bent portion 32 and the front panel 20 is minimized to provide a good appearance to the air conditioner since each hinge shaft 51*c* and its respective hole 52*a* are eccentrically positioned to the intake grille's side.

As described above, the present invention provides an air conditioner, which is designed such that the bent portion of an intake grille enters a space between the front surface of a front panel and the side extension part of a first connecting unit when opening the intake grille, thus allowing the intake grille to be opened at a wide angle, and allowing a user to easily clean or replace the intake filter with a new one.

Furthermore, according to the present invention, the rotation center of the intake grille is eccentrically positioned toward the bent portion of the intake grille so the rotation radius of the bent portion is small. The intake grille is thus easily opened and closed. In addition, the gap between the bent portion and the front panel is small when the intake grill is closed so the air conditioner of this invention has a good appearance.

Although a few embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An air conditioner having a front panel provided with an air inlet port and an intake grille connected to the front panel to cover the front of said panel, said air conditioner comprising:

a first connecting unit forwardly protruding by a predetermined length from a front surface of said front panel and having a hinge shaft on an end thereof, said first connecting unit rotatably connecting said intake grille to said front panel and allowing said intake grille to be opened; and a second connecting unit provided on an inner surface of a bent portion formed along a side of said intake grille and having a hole to receive said hinge shaft.

2. The air conditioner according to claim 1, wherein said first connecting unit comprises:

a forward extension part forwardly extending from said front panel by a predetermined length; and a side extension part extending sideward from an end of said forward extension part by a predetermined length.

3. The air conditioner according to claim 2, wherein a predetermined space is defined between the front surface of said front panel and said side extension part to receive said bent portion of said intake grille when said intake grille is rotated around said hinge shaft to be opened or closed.

4. The air conditioner according to claim 2, wherein said hinge shaft upwardly extends from an end of said side extension part.

5. The air conditioner according to claim 1, wherein said hole of the second connecting unit is eccentrically positioned proximately to an edge of said bent portion of the intake grille such that a rotation radius of said bent portion is minimized and a gap between the edge of the bent portion and the front panel is minimized when said intake grille is closed.

6. The air conditioner according to claim 1, wherein said hole of the second connecting unit is partially opened toward the front surface of said front panel to form a mouth having a width smaller than a diameter of said hinge shaft such that said intake grille is easily attached to or easily detached from said front panel.

7. The air conditioner according to claim 1, wherein said front panel has provided on the front surface thereof a vertical groove to prevent said bent portion of said intake grille from interfering with said front panel when said intake grille is rotated to be opened or closed.

8. The air conditioner according to claim 1, further comprising:

another first connecting unit forwardly protruding by a predetermined length from a front surface of said front panel and having a hinge shaft on an end thereof, said another first connecting unit positioned below said first connecting unit and rotatably connecting said intake grille to said front panel and allowing said intake grille to be opened; and another second connecting unit provided on an inner surface of a bent portion formed along a side of said intake grille and having a hole to receive said hinge shaft, said another second connecting unit positioned below said second connecting unit.

9. The air conditioner according to claim 1, wherein said second connecting unit comprises:

an upper second connecting unit located at an upper portion of a side of said intake grille; and a lower second connecting unit located at a lower portion of a side of said intake grille.

10. The air conditioner according to claim 9, wherein said connecting units have one side thereof integrally connected along the inner surface of the front wall of said intake grille and another side thereof integrally connected along the inner surface of said bent portion to provide a predetermined strength.

11. The air conditioner according to claim 3, wherein said predetermined space comprises:

a vertical groove provided along an edge of said front panel at a position adjacent to said hinge shaft of the first connecting unit to receive an edge of said bent portion when said intake grill is opened.

12. The air conditioner according to claim 9, wherein said second connecting units are elastically deformable to allow the hinge to be received within said holes.

13. The air conditioner according to claim 9, wherein said second connecting units have a flat plate shape.

14. The air conditioner according to claim 3, wherein said intake grille rotates at an angle of 90 degrees or more with respect to said front part.

15. An air conditioner comprising:

a front panel having an air inlet port; and an intake grille connected to said front panel to cover the front of said front panel, said intake grille having a bent portion such that the rotation center of said intake grille with respect to said front panel is eccentrically positioned toward said bent portion.

16. An air conditioner comprising:

a front panel having an air inlet port and upper and lower first connecting units forwardly protruding by a predetermined length from a front surface of said front panel, said upper and lower connecting units each having a hinge shaft on an end thereof, and an intake grille having a bent portion and upper and lower second connecting units provided on an inner surface of said bent portion formed along a side of said intake grille, said upper and lower connecting units having a hole to receive said hinge shafts respectively such that said bent portion enters a space between the front surface of said front panel and said hinge shafts when opening said intake grill.

* * * * *